US005779487A

United States Patent [19]

Gatin

[11] Patent Number: 5,779,487

[45] Date of Patent: Jul. 14, 1998

[54] AUTOMATIC BATTERY DISCONNECT CONNECTION

[76] Inventor: Len W. Gatin, RR 1 S12 C64, Chase, B.C., Canada, V0E 1M0

[21] Appl. No.: 652,676

[22] Filed: May 28, 1996

Related U.S. Application Data

[63] Continuation-in-part of Ser. No. 260,593, Jun. 16, 1994, abandoned.

[51] Int. Cl.[6] ..... H01R 11/30

[52] U.S. Cl. ..... 439/39; 439/522

[58] Field of Search ..... 439/38, 39, 40, 439/754, 755, 756, 757, 758, 522

[56] References Cited

U.S. PATENT DOCUMENTS

| | | | |
|---|---|---|---|
| 3,786,391 | 1/1974 | Mathauser | 439/39 |
| 3,810,258 | 5/1974 | Mathauser | 439/39 |
| 4,380,291 | 4/1983 | Shannon | 439/754 |
| 4,747,793 | 5/1988 | Fukuda et al. | 439/754 |
| 4,917,612 | 4/1990 | Priest | 439/39 |

*Primary Examiner*—Hien Vu

*Attorney, Agent, or Firm*—Knobbe,Martens, Olson & Bear

[57] ABSTRACT

An electrical connector to attach a first and second conductor. The electrical connector has first and second members. The first member can be attached to the first conductor and the second member can be attached to the second conductor. These first and second members are in turn magnetically attachable to each other. In this way, the first conductor can be held in electrical conducting relationship to the said second conductor by the magnetic attraction of the first and second members. At least one of the first and second members is a permanent magnet. The arrangement may be one member being a permanent magnet and the other a ferromagnetic material or both members may be permanent magnets.

3 Claims, 2 Drawing Sheets

AUTOMATIC BATTERY DISCONNECT CONNECTION

CROSS REFERENCE TO RELATED APPLICATION

This application is a continuation-in-part of U.S. application Ser. 08/260,593 filed 16 Jun. 1994 abandoned the disclosure of which is incorporated by reference.

FIELD OF THE INVENTION

This invention relates to an electrical connector to attach first and second conductors to each other. The invention finds particular application as a means of attaching a battery cable to a battery or attaching the ground lead to a car frame.

BACKGROUND OF THE INVENTION

One common cable connector to attach a cable to the posts of a battery comprises a cylindrical connector having an opening and attached to the end of the cable. The connector is a fairly close fit over a battery post. The connector is provided with fastening means, typically a bolt and nut, that can be tightened to close the opening to make a good electrical connection with the post and to avoid the possibility of the connector being inadvertently removed from the post. A second common connector comprises a threaded recess, usually on the side of a battery, that receives a bolt that also extends through an eye attached to the end of the cable.

Fires often occur during vehicle accidents. Prior art systems provide a secure attachment of the cables that resist any force liable to be encountered in an accident. This means that in a vehicle accident the electrical systems of a car remain live and damaged wiring and lights can cause sparks to ignite spilled fuel. Electrical power to all switches and wiring can only be disconnected by disconnecting the battery. Most Emergency Response Units are required to cut the battery cable upon arrival at serious vehicle accidents to eliminate this fire hazard. This action often comes too late. The air-fuel mix must reach its flammable range at a place where there is sparking before ignition can occur. This may take a few seconds or a number of minutes but ignition usually occurs before the battery cable can be cut. Rarely does ignition occur on impact as depicted in the movies.

SUMMARY OF THE INVENTION

The present invention seeks to eliminate this hazard by providing a quick disconnect system that will disconnect under impact. In particular disconnection is inertia activated and can take place under the influence of a lateral force.

Accordingly, and in its broadest aspect, the present invention is an electrical connector to attach a first and a second conductor comprising:

a first member adapted to be attached to said first conductor and having a first flat surface;

and a second member adapted to be attached to said second conductor and having a second flat surface;

said first and second members being magnetically attachable to each other through said first and second flat surfaces being able to lie flat against each other;

whereby the first conductor can be held in electrical conducting relationship to said second conductor by the magnetic attraction of the first and second members but can break contact by the relative movement of the first and second members upwardly, downwardly or laterally.

As indicated above, in a preferred aspect the first conductor will be a battery terminal and the second a battery cable in a vehicle.

The flat surfaces of the first and second members are held in contact by magnetic attraction to provide electrical continuity from the battery terminal to the battery cable.

BRIEF DESCRIPTION OF THE DRAWINGS

The invention is illustrated in the drawings in which.

DESCRIPTION OF THE PREFERRED EMBODIMENTS

Figure 1:
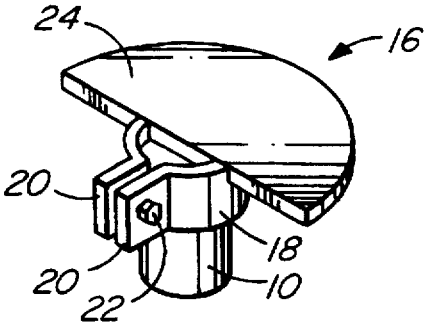
FIG. 1 is a perspective view of a first connector according to the present invention.
Figure 2:
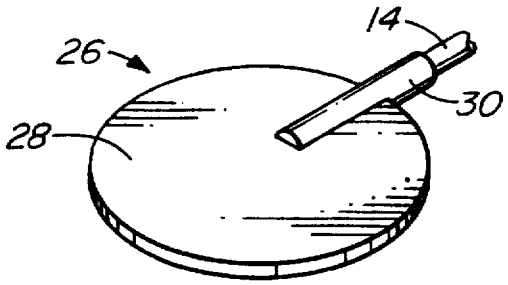
FIG. 2 is a perspective view of an electrical connector according to the present invention that is attachable to the connector of FIG. 1.
Figure 3:
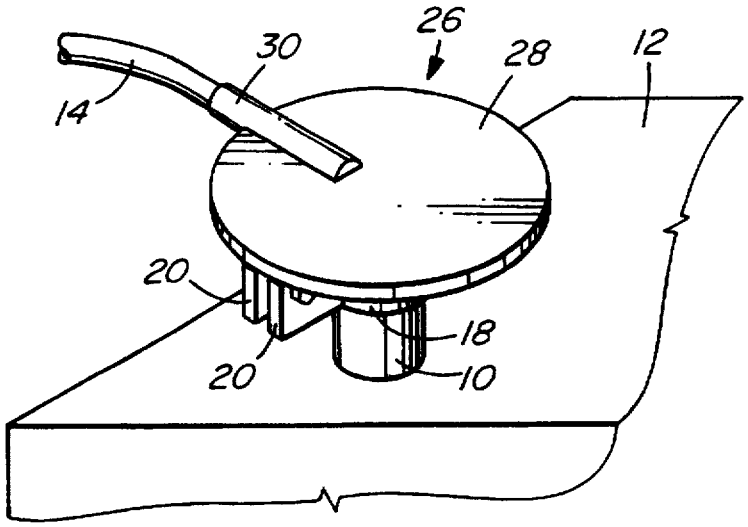
FIG. 3 shows the connector of FIGS. 1 and 2 in position on a battery.

FIGS. 1 to 3 show an electrical connector to attach a first conductor in the form of a post 10 on a battery 12 to a second conductor in the form of a cable 14.

The connector comprises two members. A first member 16 is attached to the post 10. Member 16 is shown in FIG. 1. It has a generally cylindrical base 18, to fit over the post 10, and radial lugs 20. Fastening means, for example, a conventional bolt 22 with a nut (not shown) extend through openings in the lugs 20 to ensure that the member 16 can be attached firmly to the post 10. The first member 16, as shown particularly in FIG. 1, includes a first flat surface 24, generally semi-circular, attached to the base 18 to increase the surface area of the first member 16.

The second member 26 of the connector is attached to cable 14. Second member 26 comprises a second flat surface 28 having a cylindrical housing 30 extending from it. The cable 14 is attached in conventional manner to the second member 26, for example by soldering to the cylindrical housing 30.

At least one of the first and second members 16 and 26 must be a permanent magnet. Both members 16 and 26 may be a permanent magnet or one may be a permanent magnet and the other a ferromagnetic material. In this way, the first and second members 16 and 26 are magnetically attracted, thus establishing an electrical conducting relationship between the post 10 and the cable 14. Members 16 and 26 must make contact through first and second flat surfaces 24 and 28, free of projections. This will ensure that the contact can be broken by the application of a lateral force although, of course, contact can also be broken by upward and downward forces acting on the connection.

To use the embodiment of FIGS. 1 to 3, the cylinder 18 is attached to the battery post 10 by loosening the bolt 22 and slipping the cylinder 18 over the post 10. The bolt 22 is then tightened to provide a secure attachment, and good electrical contact, between the post 10 and the first member 16. The second member 26 is permanently attached to cable 14 by sliding the cable 14 into the cylindrical housing 30 and soldering or crimping it in place. This is a conventional means of attaching a connector to a cable.

With the components attached in this way, electrical connection between the cable 14 and the battery 12 is achieved by placing the second member 26 on the first member 16. The magnetic attraction between the two bodies 16 and 26 provides an excellent attachment.

Current flow between the battery 12 and the cable 14 is as good with the invention as with the prior art system. However, on the receipt of a violent blow, for example in an accident, the first and second bodies 16 and 26 are disconnected. Experiments have shown, however, that violent braking and the like, which might be expected as a relatively normal event in driving, do not disconnect the battery. It is easy to find magnets of an appropriate strength that will disconnect only on impact or with extreme changes in vehicle velocity, such as from an impact, but not with conventional acceleration and deceleration or with relatively light blows.

Figure 4:
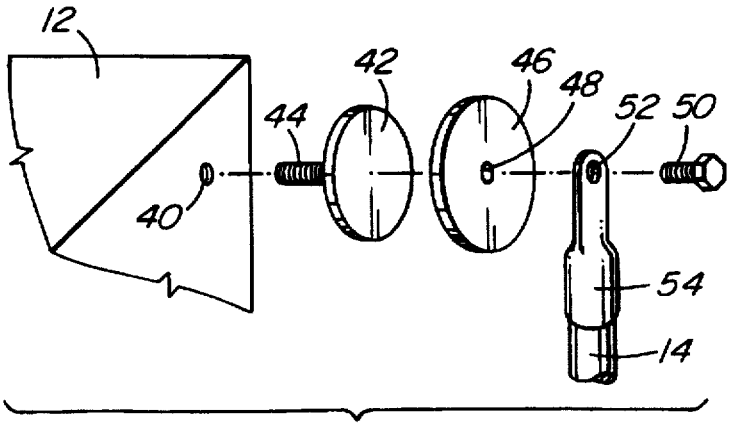
FIG. 4 shows a second connector according to the invention.

FIG. 4 shows a battery 12 having a conventional side connection which comprises a threaded opening 40. The connector illustrated in this embodiment of the invention comprises a first flat member 42 provided with a stud 44 that is received in the threaded opening 40. The threaded opening 40 is conventional and stud 44 is selected so that it can be received by opening 40.

The connector also includes a second flat member 46 having a threaded opening 48. A bolt 50 extends through an opening 52 in a cable end 54 attached to cable 14. The battery 12 with its opening 40, bolt 50, cable 14 and connector 54, with its opening 52, are conventional. They comprise a prior art connection in which bolt 50 is simply threaded directly into opening 40 through opening 52 in the connector 54.

The method of attachment shown in FIG. 4, whereby bolt 50 extends into threaded opening 48 in second member 46, is also applicable for attaching the cable 14 to the second member 26 shown in FIGS. 2 and 3. That is housing 30 may be replaced by a simple threaded opening 48, shown in FIG. 4, and the connector 54, with its eyelet 52 and the bolt 50 of FIG. 4 can then be used in the embodiment of FIGS. 1 to 3.

As in the embodiment of FIGS. 1 to 3 one or both of members 42 and 46 is a permanent magnet. Where only one is a permanent magnet, the other is of a ferromagnetic material.

In operation the embodiment of FIG. 4 is used as in the embodiment of FIGS. 1 to 3. Using a battery with a side terminal, member 42 is threaded into the opening 40. Similarly, second member 46 is attached to cable 14 by threading the bolt 50 into opening 48 through the connector 54. Electrical contact is then established by placing the second member 46 over the first member 42 to complete the circuit.

The present invention thus provides a simple means of disconnecting the battery in an accident without intervention by the driver. The invention is applicable to all conventional battery connections. No modification of any conventional battery is required. The invention fits on to existing terminals.

Figure 5:
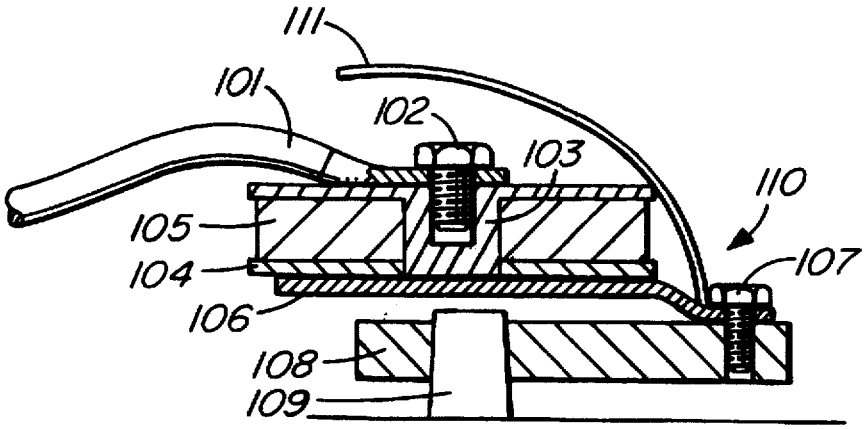
FIG. 5 is section through a further embodiment of the invention.

FIG. 5 shows a flat surfaced electrically conductive magnetic member 110 which is connected to a battery cable 101 by bolt 102 and consists of a flat surfaced metal disc **104*a* that includes a central boss 103 protruding through an aperture of an annular magnet 105 to fit conductively into the aperture of an annular base plate 104*b***.

FIG. 5 also shows a flat surfaced metal disc adaptor 106 connected to one type of battery terminal connector 108 attached to a battery terminal 109.

FIG. 5 also shows the flat surface metal disc **104*a* of the electrically conductive magnetic member 110 being mated and held by magnetic attraction and laterally slidable on the flat surface of metal disc 106 to provide electrical conductivity from cable 101 to the battery post 109**.

Figure 6:
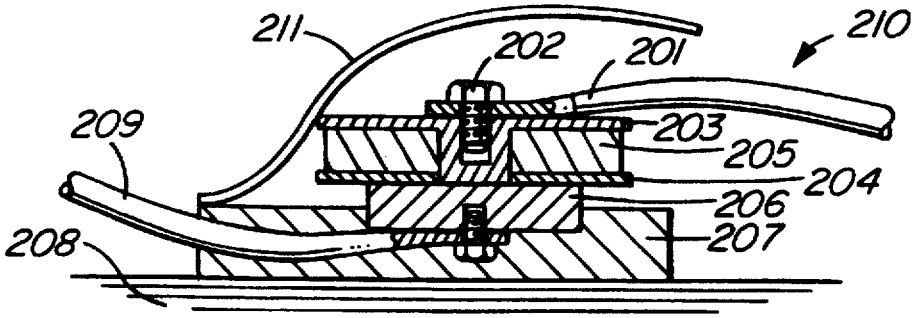
FIG. 6 is a section through an embodiment related to the embodiment of FIG. 5.

FIG. 6 shows a battery cable 209 which is attached to a battery post or side terminal (not shown) and which is also attached to a flat metal disc 206 which is embedded in an insulating block 207 which is secured to a rigid and durable part of a vehicle 208.

FIG. 6 also shows the flat surface of the electrically conductive magnetic member 210 being held by magnetic attraction in electrically conductive contact but slidable on the flat surface of the metal disc 206 to provide electrical conductivity from the battery cable 209 to the vehicle through cable 201.

FIGS. 5 and 6 also show insulating flaps 111 and 211 which provide means to insulate disc 106 and 206 from being short circuited by displaced metal when magnetic member 110 and 210 separates from disc 106 and 206 by the inertial force of collision impact. Flaps 111 and 211 are preferably resilient to resile towards disc 106 and 206 when contact is broken.

Member 110 and 210 inertia will be reduced if the battery breaks loose during a collision. Mounting the member on a rigid and durable part of the vehicle will prevent the loss of inertia required to cause the member to slide laterally from the contact member 106 and 206 to disconnect the battery circuit.

The present invention makes electrical contact through flat surfaces, magnetically attached to each other. There are no projections to impede relative movement of the flat surfaces in the event of a force being applied, especially a lateral force from any direction or any force having a lateral component. The invention also, of course, permits separation under the influence of a downward or upward force. The connection of the invention disconnects on application of a force as in, for example, a vehicle collision. This greatly reduces the danger of fire. The occupants of the vehicle may not be able to disconnect the battery. The delay for a safety crew to reach a vehicle accident and break the connection is not a factor in the present invention as the disconnection takes place under the impact of force of the collision.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

I claim:

1. A quick disconnect connector for electrically connecting an electrical cable to a terminal of a battery comprising a flat surfaced electrically conductive magnetic member connected to said electrical cable, a flat surfaced metal disc adapter connected to said battery terminal, said magnetic member and metal disc adapter being magnetically attachable to each other through abutting engagement of their respective flat surfaces to maintain said electrical conducting relationship unless the magnetic contact between said magnetic member and said metal disc adapter is broken by relative movement laterally thereof, and an insulating flap extending over said connector to provide a shield for said magnetic member and said metal disc adapter from being short-circuited when disengaged from electrical conduction between said magnetic member and metal disk.

2. A quick disconnect connector in accordance with claim 1, further characterized by said magnetic member comprising an annular-shaped magnet comprising a flat annular base plate attached to said annular-shaped magnet so as to define the flat surface of said magnetic member, said annular-shaped magnet including a centrally located electrically conductive boss for attachment to said electrical cable.

3. A quick disconnect connector in accordance with claim 2 wherein said insulting flap is resilient whereby said flap will resile to a position closer to said battery terminal when said member and adapter are disengaged from said electrical conduction.

* * * * *